US011313239B2

(12) United States Patent
De Gaillard et al.

(10) Patent No.: US 11,313,239 B2
(45) Date of Patent: Apr. 26, 2022

(54) TURBMACHINE FAN DISC

(71) Applicant: SAFRAN AIRCRAFT ENGINES, Paris (FR)

(72) Inventors: Thomas Alain De Gaillard, Moissy-Cramayel (FR); Alexandre Bernard Marie Boisson, Moissy-Cramayel (FR); Rémi Roland Robert Mercier, Moissy-Cramayel (FR); Alexis Thomas Chaboud, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/057,550

(22) PCT Filed: May 20, 2019

(86) PCT No.: PCT/FR2019/051139
§ 371 (c)(1),
(2) Date: Nov. 20, 2020

(87) PCT Pub. No.: WO2019/224464
PCT Pub. Date: Nov. 28, 2019

(65) Prior Publication Data

US 2021/0189893 A1 Jun. 24, 2021

(30) Foreign Application Priority Data

May 23, 2018 (FR) ..... 1854308

(51) Int. Cl.
*F01D 5/30* (2006.01)
*F04D 29/32* (2006.01)
(Continued)

(52) U.S. Cl.
CPC ..... *F01D 5/3007* (2013.01); *F01D 5/326* (2013.01); *F04D 29/322* (2013.01); *F04D 29/34* (2013.01);
(Continued)

(58) Field of Classification Search
CPC .... F01D 5/3007; F01D 5/3015; F01D 5/3069; F01D 5/326; F01D 5/021; F01D 5/066;
(Continued)

(56) References Cited

U.S. PATENT DOCUMENTS

2003/0194318 A1 10/2003 Duesler et al.
2009/0022593 A1* 1/2009 Oka ..... F04D 29/322 416/220 R (Continued)

FOREIGN PATENT DOCUMENTS

| | | | |
|---|---|---|---|
| FR | 3048448 | A1 | 9/2017 |
| GB | 2006883 | A | 5/1979 |
| RU | 87212 | U1 | 9/2009 |

OTHER PUBLICATIONS

Search Report dated Jan. 18, 2018, in FR Application No. 1854308 (2 pages).

(Continued)

*Primary Examiner* — Christopher Verdier
(74) *Attorney, Agent, or Firm* — Bookoff McAndrews, PLLC

(57) ABSTRACT

A disc able to support platforms and blades of a fan, and including an external surface having a succession of grooves for receiving the fan blades and teeth interposed between the grooves to support the fan platforms, an upstream face of the disc, and a plurality of radial protrusions disposed radially around the axis of the disc on the upstream face of the disc, and able to be fastened to a fan platform retaining flange, the protrusions being offset radially toward the interior of the
(Continued)

disc relative to the grooves of the disc, and being disposed circumferentially between two teeth of the disc.

9 Claims, 2 Drawing Sheets

(51) Int. Cl.
*F04D 29/34* (2006.01)
*F01D 5/32* (2006.01)

(52) U.S. Cl.
CPC ..... *F05D 2220/36* (2013.01); *F05D 2260/31* (2013.01); *F05D 2260/941* (2013.01)

(58) Field of Classification Search
CPC ..... F04D 29/34; F05D 2220/36; F05D 2260/941; F05D 2260/31
USPC ..... 416/220 R
See application file for complete search history.

(56) References Cited

U.S. PATENT DOCUMENTS

| | | | | |
|---|---|---|---|---|
| 2010/0150724 | A1 | 6/2010 | Forgue et al. | |
| 2011/0033292 | A1 | 2/2011 | Huth | |
| 2011/0243744 | A1* | 10/2011 | Forgue | F01D 5/3007 416/204 A |
| 2016/0319680 | A1* | 11/2016 | Roman-Morales | F01D 5/3007 |
| 2016/0319747 | A1* | 11/2016 | Pirolla | F02C 7/18 |

OTHER PUBLICATIONS

International Search Report issued in International Application No. PCT/FR2019/051139 dated Sep. 6, 2019 (3 pages).

* cited by examiner

FIG.3
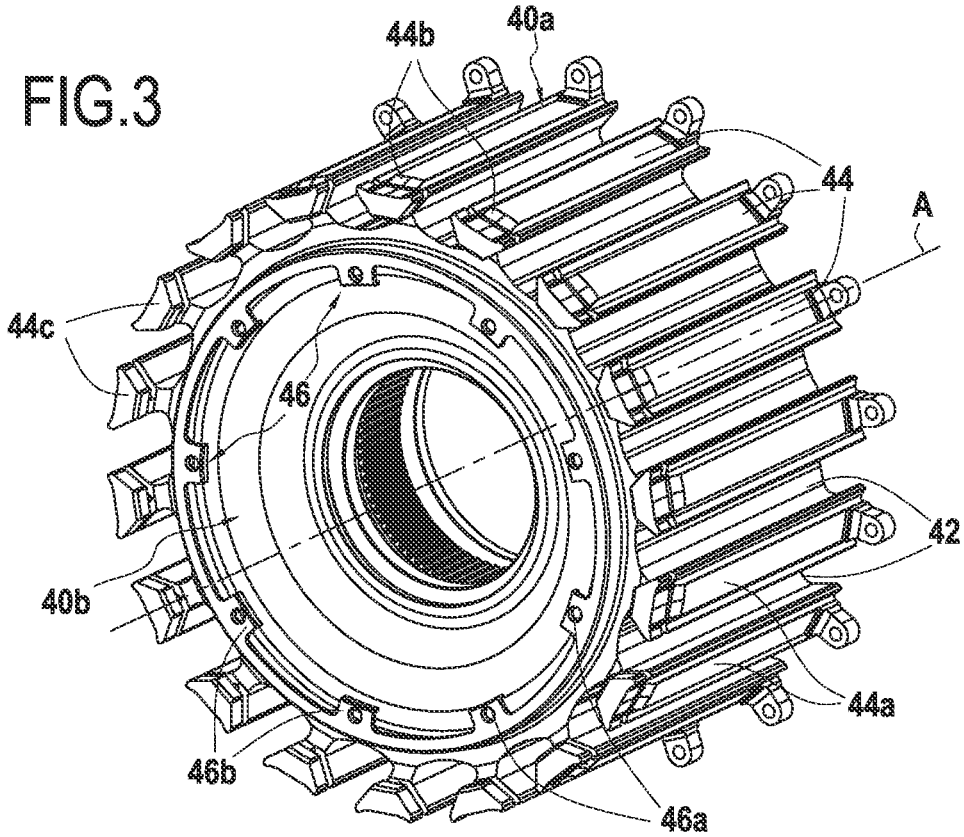
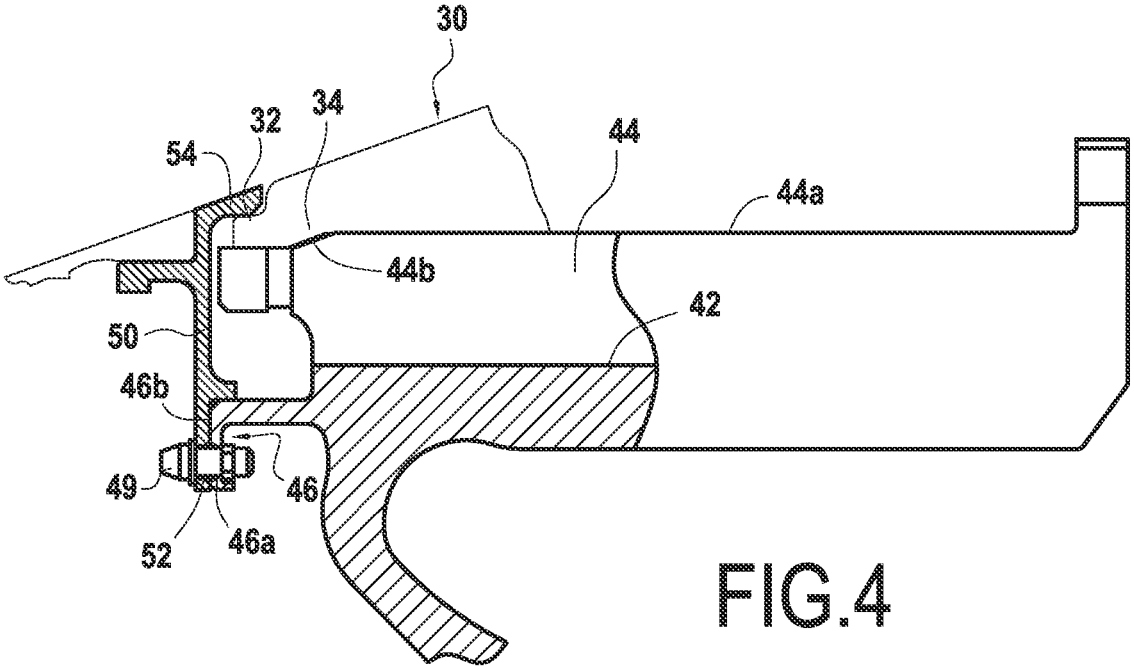
FIG.4

TURBMACHINE FAN DISC

CROSS-REFERENCE TO RELATED APPLICATION(S)

This application is the U.S. national phase entry under 35 U.S.C. § 371 of International Application No. PCT/FR2019/051139, filed on May 20, 2019, which claims priority to French Patent Application No. 1854308, filed on May 23, 2018.

FIELD OF THE INVENTION

The present invention relates to the general field of aeronautical turbomachines, and more precisely the field of fan discs of an aeronautical turbomachine, an assembly comprising the fan platforms and the disc, and a fan comprising this assembly.

STATE OF THE PRIOR ART

In a turbomachine, the blade platforms of the fan must provide several functions. From an aerodynamic point of view, these platforms have the primary function of defining the air flow stream of the air. In addition, they must also be capable of resisting large forces while deforming as little as possible and while remaining integral with the disc that carries them.

In order to satisfy these different requirements, certain configurations have been proposed in which the platforms have a first portion allowing defining the air flow stream and ensuring the retention of the platform when the motor is in rotation, and a second portion allowing limiting the deformations of the first portion under the influence of the centrifugal forces and maintaining the platform in position when the engine is stopped.

In the existing solutions, the platform can take the form of a box with a two-dimensional stream wall retained downstream by a drum and upstream by a shroud, the upstream retention by the shroud being accomplished above the tooth of the fan disc (one flange of the shroud axially and radially blocking the platform upstream).

An upstream retention of this type carried out above the tooth of the disc with a shroud has the disadvantage of imposing a high hub ratio, the hub ratio being the radius ratio taken between the axis of rotation and the outermost point on the leading edge of the blade.

Moreover, this upstream retention is likely to cause overstresses in the tooth and in the disc socket, at the connection between the shroud and the disc.

In order to optimize the performance of the fan, and more generally of the turbomachine, it is desirable to have an assembly of an applied fan blade platform on a fan disc which has the smallest possible hub ratio, while limiting the stresses at the tooth and the socket of the disc.

PRESENTATION OF THE INVENTION

One embodiment relates to a disc able to support platforms and blades of a fan, and including:

- an external surface having a succession of grooves for receiving the fan blades and teeth interposed between the grooves to support the fan platforms,
- an upstream face of the disc, and
- a plurality of radial protrusions disposed radially around the axis of the disc on the upstream face of the disc, and able to be fastened to a fan platform retaining flange, the protrusions being offset radially toward the interior of the disc relative to the grooves of the disc, and being disposed circumferentially between two teeth of the disc.

By "upstream face" is meant upstream relative to the direction of flow of the air, when the disc is disposed in a fan.

By "axial protrusions" is meant axial in the direction of flow of the air, or along the axis of rotation of the disc, when the disc is disposed in a fan.

By "offset radially" is meant offset toward the interior of the disc, i.e. toward the axis of rotation of the disc.

The radial protrusions being offset radially toward the interior of the disc relative to the grooves of the disc, and disposed circumferentially between two teeth of the disc, when the protrusions are fastened to a platform retaining flange, the fastening zone being located on the protrusions is thus offset radially and circumferentially relative to the teeth of the disc. This has the advantage of limiting the stresses at the tooth of the disc when an external element, for example a platform retaining flange, is fastened to the disc.

Moreover, this fastening zone being radially offset relative to the teeth of the disc, this has the advantage of liberating space in the upstream axial end of the tooth of the disc, allowing for example machining the tooth of the disc. Machining of this type can allow the modification of the shape of the upstream axial end of a platform supported by said tooth, relative to known platforms, and thus modifying the air flow stream when the platform is disposed in a fan. It is thus possible to reduce the hub ratio in order to improve the performance of the fan, and therefore of the turbomachine in which the fan is mounted.

In certain embodiments, the radial protrusions are tabs machined on the upstream face of the disc and folded toward the center of the disc.

The tabs can have a principal face perpendicular to the axis of the disc, and a thickness, along the axis of the disc, that is small relative to the dimensions of the principal face. The shape of these radial protrusions has the advantage of being simple to make.

In certain embodiments, one face of the radial protrusions includes an opening with an axis parallel to the axis of the disc.

The opening can be made on the principal face of the tab. It allows fastening an exterior element to the disc, for example a retaining flange or a ferrule, by means of a screw or a bolt, for example.

In certain embodiments, in an upstream side view of the disc along the axis of the disc, the center of the opening of each radial protrusion is disposed on a straight line passing through the center of the disc and the bottom of a groove of the disc, the bottom of a groove being the point in the groove, in this view, situated at equal distance from the two teeth between which it is located.

In other words, the center of the opening of each radial protrusion is aligned radially with the bottom of a groove. The end of the teeth of the disc is the seat of high mechanical stresses when the disc is disposed in a fan. This disposition thus allows optimizing the circumferential spacing, in the upstream side view of the disc along the axis of the disc, from the center of each protrusion relative to the two teeth, where the mechanical stresses are high, between which it is located. The fastening of a shroud or ferrule to the radial protrusions can then be carried out in a less mechanically stressed zone than if the protrusions were aligned with the teeth. The distribution of stresses within the disc, when it is disposed in a fan, is thus optimized, and the existence of local excess stresses can thus be limited or avoided.

In certain embodiments, a radius of the disc being a segment between the center of the disc and the bottom of a groove, a distance between the center of the disc and the center of the opening of the radial protrusion is less than 95% of the radius of the disc, preferably less than 90%, more preferably less than 80%.

The fact of moving the center of the opening of the radial protrusion closer to the center of the disc allows spacing the more mechanically stressed zones from the fastening point between a shroud and the disc, when it is disposed in a fan.

In certain embodiments, the radial protrusions are disposed on the upstream face of the disc at regular intervals along the circumference of the disc. This allows a uniform distribution of the mechanical stresses on the upstream face of the disc, when a shroud is fastened to it.

In certain embodiments, the number of radial protrusions is equal to half the number of grooves of the disc.

Preferably, the radial protrusions are distributed at regular intervals in such a manner as to be aligned radially with the bottom of one groove in every two. Consequently, two times fewer connection means are necessary between the disc and a shroud, when a shroud is fastened to the disc, than if a radial protrusion were provided for each groove. This allows reducing the number of assembly steps and the number of connection parts necessary. The time and cost of assembly can thus be limited.

The present disclosure also relates to an assembly comprising a disc according to any one of the preceding embodiments, at least one platform, and at least one upstream retaining flange to ensure the axial and radial retention of the upstream axial end of the platform, wherein the upstream retaining flange is fastened to the radial protrusions of the upstream face of the disc.

When the retaining flange is fastened to the disc, the interface between the flange and the disc, corresponding to the fastening zone of the flange to a radial protrusion of the disc, is offset radially toward the interior of the disc, relative to a groove of the disc, and is circumferentially interposed between two teeth of the disc, unlike known systems in which this interface is located at the tooth of the disc. This offset allows limiting the stresses at the upstream axial end of the teeth. Moreover, the offset of this interface allows liberating space at the upstream axial end of the tooth of the disc, offering better possibilities of machining the tooth and therefore of modifying the shape of the platform and thus, reducing the hub ratio.

In certain embodiments, the upstream retaining flange is a shroud.

The present disclosure also relates to a turbomachine fan comprising an assembly according to any one of the embodiments described in the present disclosure, and a plurality of blades mounted in the grooves of the disc.

BRIEF DESCRIPTION OF THE DRAWINGS

The invention and its advantages will be better understood upon reading the detailed description made hereafter of different embodiments of the invention, given by way of non-limiting examples. This description refers to the appended pages of figures, in which:

FIG. 3 is a perspective view of a disc according to the invention, FIG. 4 is a longitudinal section view of an assembly comprising a retaining flange, a platform and a disc according to the invention.

DETAILED DESCRIPTION OF EMBODIMENTS

In the present disclosure, the term "longitudinal" and its derivatives are defined relative to the principal direction of the platform considered; the terms "radial," "interior" and their derivatives are, for their part, defined relative to the axis of the disc, corresponding to the principal axis of the turbomachine; finally, the terms "upstream" and "downstream" are defined relative to the flow direction of the fluid passing through the turbomachine. Thus, unless otherwise indicated, the same reference symbols designate the same features on different figures.

Figure 1:
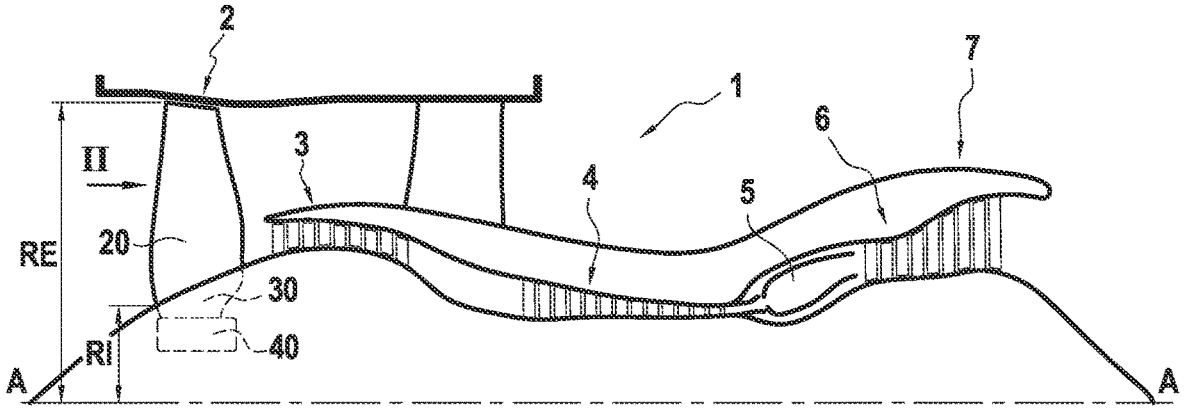
FIG. 1 is a schematic section view of a turbomachine according to the invention.

FIG. 1 shows a schematic view in longitudinal section of a double flow turbojet 1 centered on the axis A according to the invention. It comprises, from upstream to downstream: a fan 2, a low-pressure compressor 3, a high-pressure compressor 4, a combustion chamber 5, a high-pressure turbine 6, and a low-pressure turbine 7.

Figure 2:
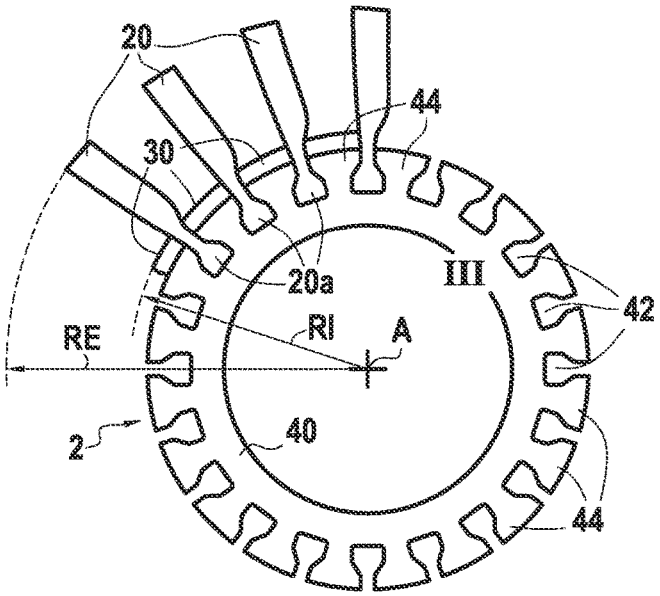
FIG. 2 is a schematic view in the direction II of the fan of FIG. 1.

FIG. 2 shows a schematic view of the fan 2 of FIG. 1 in the direction II. The fan 2 comprises a fan disc 40 in which a plurality of grooves 42 are formed in its outer periphery. These grooves 42 are rectilinear and extend axially from upstream to downstream all along the disc 40. In addition, they are distributed regularly all around the axis A of the disc 40. In this manner, each groove 42 defines with its neighbor a tooth 44 which also extends axially from upstream to downstream all along the disc 40. Equivalently, a groove 42 is delimited between two adjacent teeth 44.

The fan 2 also comprises a plurality of blades 20 with a curvilinear profile (only four blades 20 are shown in FIG. 2). Each blade 20 has a root 20*a* which is mounted in a respective groove 42 of the fan disc 40. To this end, the root 20*a* of a blade 20 can have a pine tree or a dovetail shape suited to the geometry of the grooves 42.

Finally, the fan 2 comprises a plurality of applied platforms 30, each platform 30 being mounted in the interval between two adjacent fan blades 20, in proximity to their roots 20*a*, in order to delimit, on the interior side, an annular air entry stream in the fan 2, the stream being delimited on the exterior side by a fan casing.

FIGS. 1 and 2 also show an inner radius RI and an outer radius RE. The inner radius RI corresponds to the radius taken between the axis of rotation and the point in the leading edge of a blade 20 flush with the surface of a platform 30. The external radius RE corresponds, for its part, to the radius taken between the axis of rotation A and the outermost point of the leading edge of a blade 20. These two radii RI, RE, are those used in calculating the hub ratio RI/RE. The fact of reducing the inner radius RI allows reducing this hub ratio. In other words, the reduction of the hub ratio, by acting in particular on the inner radius RI, amounts to causing the aerodynamic air entry stream to approach the fan disc as closely as possible.

FIG. 3 shows a perspective view of a fan disc comprising an external surface 40*a* and an upstream face 40*b*. The outer surface 40*a* has a succession of grooves 42 in which a root 20*a* of a fan blade 20 can be accommodated, and teeth 44 interposed between the grooves 42, which can support the fan platforms 30. Each tooth 44 can include a main tooth surface 44*a*, and a tapered surface 44*b* at its upstream axial end.

Moreover, the disc 40 comprises, on its upstream face 40*b*, a plurality of radial protrusions 46, having the shape of tongues, and being disposed circumferentially at regular intervals around the axis A. These protrusions can be made for example by machining the upstream face 40*b* of the disc, for example on the disc stem. The number of radial protrusions 46 can be equal to half the number of grooves 42, each protrusion 46 being aligned radially with the corresponding groove 42. In other words, each protrusion 46 is interposed circumferentially between two teeth 44 of the disc 40. Moreover, each radial protrusion 46 is radially offset toward the interior of the disc, i.e. toward the axis A, relative to the corresponding groove 42.

Each radial protrusion 46 can include a fastening opening 46*a* on its upstream face 46*b*, allowing inserting a fastening means 49, for example a screw or a bolt. The attachment of an upstream retaining flange 50, a shroud for example, can thus be carried out at a radial protrusion 46, for example by inserting the fastening means 49 through a flange opening 52 and the fastening opening 46*a* of the protrusion, the fastening means 49 then being fastened, for example by a bolt, to the radial protrusion 46. The retaining flange 50 being fastened to the disc 40, an upper surface 54 of the flange 50 then allows ensuring the radial retention of a retaining surface 32 situated at the upstream axial end of the platform 30.

The fastening zone between the disc 40 and the retaining flange 50 being situated at the radial protrusions 46, therefore closer to the center of the disc, allows limiting the stresses exerted during the operation of the fan at sensitive surfaces such as the upstream axial end of the teeth 44. Moreover, this interface between the disc 40 and the retaining flange 50 being offset radially relative to the grooves in the disc, in comparison to known structures, the cantilevers 44*c*, usually allowing the fastening of the shroud to the upstream end of the disc teeth, can be eliminated. This allows liberating space at the upstream axial end of the teeth 44 of the disc. It is also possible to modify more freely the upstream axial end of the teeth 44, and therefore the upstream axial end of the platform 30, for example by providing an inclined wall 34 over the upstream end of the platform 30, the inclined wall 34 coming into contact with the tapered surface 44*b* of the tooth 44. It is thus possible to reduce the hub ratio in order to optimize the performance of the fan, and therefore of the turbomachine in which the fan is mounted.

Although the present machine has been described by referring to specific embodiments, it is obvious that modifications and changes can be performed on these examples without departing from the general scope of the invention as defined by the claims. In particular, individual features of the different embodiments illustrated/mentioned can be combined into additional embodiments. Consequently, the description and the drawings can be considered in an illustrative, rather than a restrictive sense.

The invention claimed is:

1. A disc configured to support platforms and blades of a fan, and including:

an external surface having a succession of grooves for receiving the fan blades and teeth interposed between the grooves to support the fan platforms, an upstream face of the disc, an annular axial protrusion disposed radially around an axis of the disc on the upstream face of the disc, and a plurality of radial protrusions disposed radially around the axis and extending from an upstream face of the annular axial protrusion towards the center of the disc, and configured to be fastened to a fan platform retaining flange, the protrusions being offset radially toward the interior of the disc relative to the grooves of the disc, and being disposed circumferentially between two successive teeth of the disc, the number of radial protrusions being equal to half the number of grooves of the disc.

2. The disc according to claim 1, wherein the radial protrusions are tabs machined on the upstream face of the disc and folded toward the center of the disc.

3. The disc according to claim 1, wherein each respective face of a respective radial protrusion includes a respective opening with an axis parallel to the axis of the disc.

4. The disc according to claim 3, wherein, in an upstream side view of the disc along the axis of the disc, the center of the opening of each radial protrusion is disposed on a straight line passing through the center of the disc and the bottom of a groove of the disc, the bottom of a groove being the point in the groove, in this view, situated at equal distance from the two teeth between which the groove is located.

5. The disc according to claim 4, wherein, a radius of the disc being a segment between the center of the disc and the bottom of a groove, a distance between the center of the disc and the center of the opening of the radial protrusion is less than 95% of the radius of the disc.

6. The disc according to claim 1, wherein the radial protrusions are disposed on the upstream face of the disc at regular intervals along the circumference of the disc.

7. An assembly comprising the disc according to claim 1, at least one of the platforms, and at least one upstream retaining flange to ensure the axial and radial retention of an upstream axial end of the at least one of the platforms, wherein the at least one upstream retaining flange is fastened to the radial protrusions of the upstream face of the disc.

8. The assembly according to claim 7, wherein the at least one upstream retaining flange is a shroud fastened to each radial protrusion by means of a bolt.

9. A turbomachine fan comprising the assembly according to claim 7, and a plurality of the blades mounted in the grooves of the disc.

* * * * *